United States Patent [19]

Klafka

[11] 4,000,891

[45] Jan. 4, 1977

[54] BACK-UP BRAKE ASSEMBLY FOR A PARTITION STRIP FEEDING MECHANISM IN A PARTITION FABRICATING MACHINE

[75] Inventor: Frank L. Klafka, Milwaukee, Wis.

[73] Assignee: Clevepak Corporation, New York, N.Y.

[22] Filed: Feb. 28, 1975

[21] Appl. No.: 553,972

[52] U.S. Cl. ..... 271/8 R; 226/151

[51] Int. Cl.[2] ..... B65H 5/00

[58] Field of Search ..... 271/8, 42; 198/227; 226/151

[56] References Cited

UNITED STATES PATENTS

| | | | |
|---|---|---|---|
| 2,388,423 | 11/1945 | Langdon | 226/151 |
| 2,685,362 | 8/1954 | Larsen | 226/151 |
| 3,304,082 | 2/1967 | Cunningham | 271/42 |

*Primary Examiner*—Robert W. Saifer
*Attorney, Agent, or Firm*—Rogers, Eilers & Howell

[57] ABSTRACT

A back-up brake assembly for a partition feeder mechanism for preventing back-up movement of a partition strip fed therepast. The assembly comprises a partition guide having a guide surface for movement of a partition strip therealong from a receiving end to a forward end. A pivot arm is mounted for pivotal movement about a generally vertical axis and has an end adapted for engagement with a partition strip as it moves therepast. Means are provided for biasing the engaging end of the arm toward the guide surface for engagement with a partition strip as it moves past. The relative locations of the pivotal axis, and the engaging end of the arm are such that forward movement of the partition strip through the guide means into contact with the engaging end of the arm, moves the engaging end away from the guide surface causing pivotal movement of the arm against the bias, and further such that a back-up movement of the partition strip while engaged with the engaging end of the arm produces a moment about the pivotal axis tending to pivot the arm in the opposite direction and move the engaging end toward the guide surface, thereby wedging the partition strip between the engaging end and the guide surface.

A recess is provided in the guide surface adjacent the engaging end of the arm such that a portion of the partition strip overlying the recess is urged into the recess by the engaging end under a force tending to urge the partition strip to back up.

18 Claims, 5 Drawing Figures

FIG. 1.
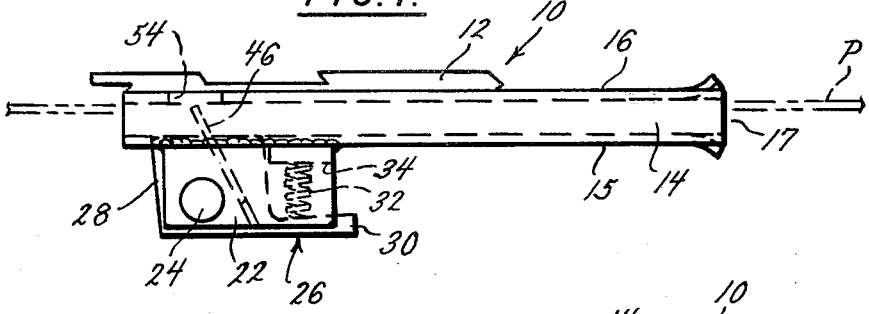
FIG. 2.
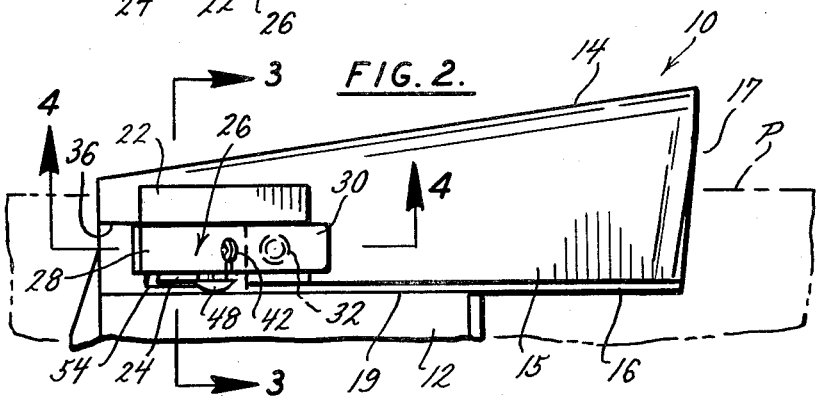
FIG. 4.
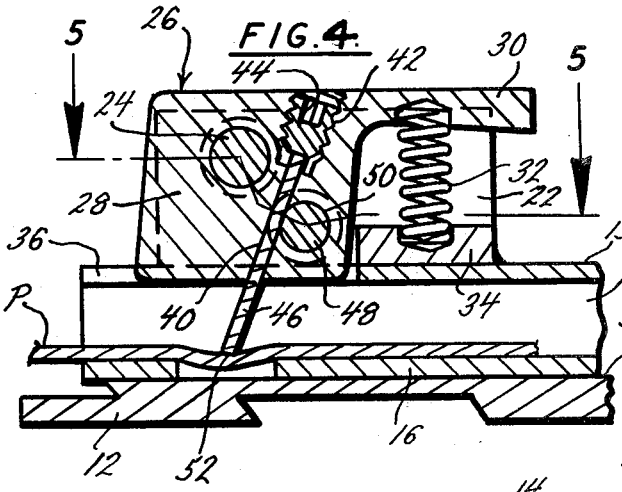
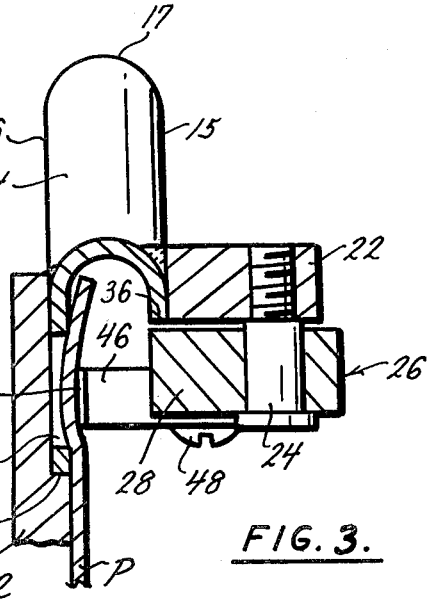
FIG. 3.
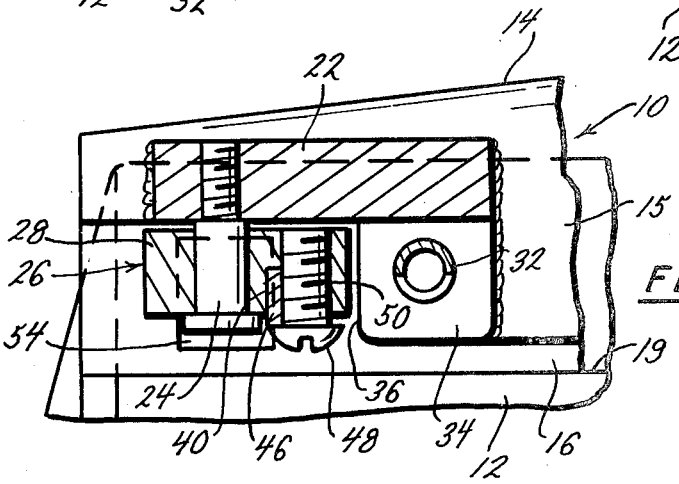
FIG. 5.

BACK-UP BRAKE ASSEMBLY FOR A PARTITION STRIP FEEDING MECHANISM IN A PARTITION FABRICATING MACHINE

BACKGROUND OF THE INVENTION

This invention relates to a back-up brake assembly, and particularly such an assembly used in a strip feeding mechanism for feeding partition strips to a partition fabricating machine. An example of the feeding mechanism referred to is disclosed in U.S. Pat. No. 3,304,082. The fabricating machine referred to may be generally of the type disclosed in U.S. Pat. No. 2,163,923.

Specifically, the back-up bake assembly of this invention is an improvement over the device best shown in FIGS. 8 and 11, and also shown in FIGS. 14, 17, 18, and 19 of U.S. Pat. No. 3,304,082, incorporated herein by reference. The reference numerals hereinafter referred to in this background section are those of said referenced patent.

The back-up brake assembly is identified by the reference numerals 105 through 121 and is mounted at the top of a vertically disposed elongated plate identified by the numeral 51. The function of the back-up brake assembly is to prevent back-up movement of the partition strip 50 upon reciprocation of the partition strip feeding assembly 37.

The partition strip feeding assembly feeds a partition strip 50 by a reciprocating movement into position for assembly with transverse partition strips. As the reciprocating feeder, as shown in FIGS. 29, 30, and 31 of said patent, retracts, it moves along the surface of the partition strip it has just fed with a tendency to pull that strip rearwards. The back-up brake assembly prevents such rearward movement of the strip.

Although the back-up brake assembly described in said patent operated satisfactorily, it had certain disadvantages. The primary disadvantage was that proper operation required that the edge 119 of the finger 118 engage the edge of one of the cutouts 215 in the partition strip 50. The purpose for the cutouts 215 is for reception of the cross partition strips. The prior art brake assembly would not brake or hold the strip unless the edge 119 engaged the edge of a cutout 215. For this reason, adjustability of the location of the brake assembly was required along the length of the hood 105 by means of the lead screw 111 so that the edge 119 could be accurately located relative to the cutouts 215. Thus, a time consuming adjustment was required whenever a change in strips with different cell sizes was made, and minor adjustment was often required during operation with partition strips of a single cell size since the adjustment was quite critical.

It was even necessary to have different sizes of hoods both in length and in height in order to accommodate the wide variations in cell size requirements. Because of the necessity for adjusting the location of the brake by means of the lead screw, and because the brake had to be located one cell size back from the assembly point, a single size hood assembly could not accommodate the total expanse of cell size variation. Also, because the cutouts were longer for deep cell sizes, brake assemblies with hoods of different heights had to be used. Thus, setup time was required to change from one size brake assembly to another where partition cell size changes so required. This had the further disadvantage of requiring an inventory of different sizes of brake assemblies.

The prior art device would not operate satisfactorily without engagement of the edge 119 with the edge of a cutout 215 because of the operation of the spring. The spring would have had to supply the holding force, and if it were made strong enough for this purpose, the strips could not pass forwardly between the finger 118 and the wall of the hood 105.

The improvement of this invention eliminates these disadvantages and provides a back-up brake assembly that firmly holds or brakes the partition strip against back-up movement without the need for adjustment as with the prior art device, and without the need to engage the edge of a cutout in the partition strip. Only one size brake assembly is needed and it can be made considerably smaller.

SUMMARY OF THE INVENTION

Generally the back-up brake assembly of this invention comprises a hood of generally inverted U-shaped cross section providing an elongated channel or guide along which the upper edges of the partition strips move toward the assembly point. A mounting block is secured to the front wall of the hood near its forward end. A pivot arm is pivotally mounted to and beneath the mounting block and has an elongated portion extending rearwardly of the pivot point and a finger blade holder portion extending generally toward a back wall of the hood. A spring is mounted between the hood and the rearwardly extending portion of the pivot arm at a location to the rear of the pivot point.

A finger blade is mounted to the blade holder portion of the pivot arm and extends from the pivot arm toward and in contact with a partition strip as it moves along the back wall of the hood. The blade is located generally in back of or behind the pivotal axis of the arm, and extends at an inclined angle toward the forward end of the hood. A recess or opening is provided in the back wall of the hood adjacent the end of the finger blade into which an overlying portion of the partition strip is pressed due to engagement by the finger blade. The recess cooperates with the finger blade in holding the partition strip against back-up or rearward movement.

Any tendency of the partition strip to back up during the feeding operation, forces the finger blade against the side of the strip adjacent the recess to hold it in place. The greater the tendency for the strip to back up, the greater the force applied by the blade to hold it in place. The spring acts to bias the blade against the partition strip, but does not provide the holding force. The holding force is created by the relative positions of the pivotal axis of the blade, and the cooperation between the blade and the recess.

Thus, it is the object of this invention to provide an improved back-up brake assembly which overcomes the disadvantages described above and which provides a positive and firm brake against back-up or rearward movement of a partition strip with engagement anywhere along the side of the strip without the need to engage an edge of a cutout in the strip, and without the need for critical adjustment of the location of the assembly, either vertically or horizontally, for variations in cell size.

DESCRIPTION OF THE DRAWINGS

FIG. 1 is a top plan view of a back-up brake assembly of this invention;

FIG. 2 is a front elevation view of the assembly of FIG. 1;

FIG. 3 is a view in section taken generally along the line 3—3 of FIG. 2;

FIG. 4 is a view in section taken generally along the line 4—4 of FIG. 2; and

FIG. 5 is a view in section taken generally along the line 5—5 of FIG. 4.

DETAILED DESCRIPTION OF A PREFERRED EMBODIMENT

Referring to the drawings there is shown a back-up brake assembly 10 of this invention mounted at the top of a vertical plate 12, which may be the plate identified by numeral 51 in U.S. Pat. No. 3,304,082. The brake assembly 10 comprises a guide or hood 14 of generally inverted U-shaped cross section, with a front wall 15, a back wall 16, and a partition strip receiving end 17, the back wall 16 being mounted at its forward end in a recess 19 at the top end of the plate 12, such as by welding, braising, or the like.

A mounting block 22 is secured to the outer surface of the wall 15 near the forward end of the hood such as by welding, braising, or the like. The block 22 has a vertical bore to receive, in locking engagement, a pivot pin 24.

A pivot arm 26 is pivotally mounted to and beneath the block 22 and includes an enlarged blade holder portion 28 and an elongated portion 30 extending rearwardly therefrom. The pivot arm 26 has a vertical bore in its enlarged portion 28 through which the pin 24 extends for pivotal movement of the arm 26 about the pin. A spring 32 is mounted between the elongated portion 30 of the arm 26 and a spring mounting block portion 34 of the block 22 for biasing the pivot arm in its operative position as shown. The elongated portion 30 and block portion 34 have suitable recesses for receiving the ends of the spring.

The front wall 15 at its forward end is cut away or notched as shown at 36 to allow pivotal movement of the enlarged portion 28 of the arm 26 past the front wall 15 and toward the back wall 16.

The enlarged portion 28 of the arm 26 has a slot 40 in its bottom side preferably oriented in a direction inclined toward the forward end of the assembly away from an axis normal to the wall 15. It is preferred that this angle of inclination be in the range of about zero to 45°, and in this described embodiment an angle of about 20° is shown as it has been found to give excellent results. The slot 40 extends from the back edge of the enlarged portion 28 part way toward the front edge. A threaded bore 42 extends from the front surface of the arm 26 to the front end of the slot 40. The threaded bore 42 is in axial alignment with, and intercepts, the groove 40 as shown. The bore 42 receives a set screw 44 for purposes to be described.

A finger blade 46, preferably of spring steel, is mounted in the slot 40 and is held in place by a locking screw 48 mounted in a vertically threaded hole 50 adjacent the slot. Engagement of the head of the screw 48 against the lower edge of the blade 46 locks the blade in place. With the screw 48 loosened, the extension of the blade 46 can be adjusted by means of the set screw 44 to achieve a relatively fine adjustment. The blade 46 has an edge 52 which is preferably sharpened for engagement with the partition strips as they move past.

A recess or opening 54 is formed in the back wall 16 of the hood 14 adjacent the edge 52 of the blade. In this embodiment, the opening is square, although other shapes could be used.

OPERATION

The operation of the brake assembly is evident from the foregoing description. By way of summary, the extension of the blade 46 is adjusted by means of the set screw 44 for a partition strip of a given thickness. The blade 46 should be adjusted such that the direct distance from the edge 52 and the wall 16 is less than the thickness of the strip to be run without a partition strip in the guide and with the arm 26 fully biased. In the preferred embodiment shown, the edge 52 is approximately directly behind the axis of the pivot pin 24.

As a partition strip P enters the receiving end 17 and moves forwardly within the hood 14 to contact the blade 46, the blade is pushed away from the recess 54 causing the arm 26 to pivot about the pin 24 against the spring 32 which holds the edge of the blade against the surface of the partition strip. With the blade so engaged, any tendency for the partition strip to back up, or move rearwardly, such as by reciprocation of a feeder device, will pull the blade slightly rearwardly. This will produce a pivot of the arm 26 in the counterclockwise direction as viewed in FIG. 4, causing the blade to engage the strip more firmly and even cause the portion of the strip overlying the opening 54 to bulge slightly into the opening. This increases the holding or braking action even more, as the strip is effectively pinched between the edge of the opening and the edge of the blade.

It will be noted that in the embodiment shown, the edge 52 is about on a line through the pivotal axis and normal to the plane of the strip. This configuration, by engagement of the edge 52 with the surface of the partition strip, produces a moment on the arm 26 which tends to pivot the arm 26 counterclockwise as viewed in FIG. 4 and drive the edge 52 against the strip with greater force to prevent it from backing up. Preferably, a line drawn between the pivotal axis and the edge 52 should be no greater than 45° to the forward direction from the normal line. It is especially preferred that the edge 52 should be approximately on said normal line or slightly forward of it. The relative positions of the pivotal axis and the edge 52, together with the angle of the blade should be so as to produce a moment as heretofore described. This moment, combined with the increased binding or pinching action produced by the opening 54, provide the improved braking action.

Thus, there has been described an improved back-up brake assembly which overcomes the disadvantages, and fulfills the object, described above.

Various changes and modifications may be made in this invention, as will be readily apparent to those skilled in the art. Such changes and modifications are within the scope and teaching of this invention as defined by the claims appended hereto.

What is claimed is:

1. A back-up brake assembly for a partition feeder mechanism for preventing back-up movement of a partition strip fed therepast, said assembly comprising a partition guide having a guide surface for movement of a partition strip therealong from a receiving end to a forward end, a pivot arm, means for mounting the arm for pivotal movement about a generally vertical axis, said arm having an end adapted for engagement with a partition strip as it moves therepast, means resiliently biasing said engaging end toward said guide surface for engagement with a partition strip as it moves past, said guide surface having a recess therein adjacent the engaging end of the pivot arm, the portion of the partition strip overlying the recess being urged into said recess by said engaging end under a force tending to urge the partition strip to back up.

2. The assembly of claim 1 wherein said engaging end of said pivot arm further comprises a finger member extending from said arm toward said guide surface and having an edge for engagement with said strip.

3. The assembly of claim 2 wherein said finger member further comprises a blade made of a resilient material.

4. The assembly of claim 2 wherein said finger member extends from said arm at an angle of between about zero to 45° as measured in the forward direction from an axis normal to the plane of the strip.

5. The assembly of claim 4 wherein said angle is about 20°.

6. The assembly of claim 1 wherein the arm includes a portion extending rearwardly from said pivotal axis, and wherein said resiliently biasing means further comprises a spring means mounted to the rear of said pivotal axis and biasing the rearwardly extending portion away from said partition strip.

7. The assembly of claim 1 wherein the angle between a line extending through said pivotal axis and said engaging end and a line between said pivotal axis normal to the plane of the partition strip, with the arm in its fully biased position and without the presence of a partition strip, is such that forward movement of a partition strip through said guide means into contact with said engaging end moves said engaging end away from said guide means causing pivotal movement of said arm against said bias, and such that a back-up movement of said partition strip while engaged with said engaging end produces a moment about said pivotal axis tending to pivot said arm in the opposite direction and move said engaging end toward said guide surface.

8. The assembly of claim 7 wherein said angle is between approximately zero and 45° in the forward direction.

9. The assembly of claim 8 wherein said angle is approximately zero degrees.

10. The assembly of claim 2 wherein said finger member extends toward said recess at least as far as said guide surface.

11. The assembly of claim 10 wherein the extension of said finger member is adjustable.

12. A back-up brake assembly for a partition feeder mechanism for preventing back-up movement of a partition strip fed therepast, said assembly comprising a partition guide having a guide surface for movement of a partition strip therealong from a receiving end to a forward end, a pivot arm, means for mounting the arm for pivotal movement about a generally vertical axis, a blade of resilient material extending from said arm toward said guide surface and having an edge for engagement of said strip, means resiliently biasing said edge of said blade toward said guide surface for engagement with a partition strip as it moves past, the angle formed between a line extending from said pivotal axis through said edge of said blade and a line extending from said pivotal axis normal to the plane of said partition strip, with the arm in its fully biased position and without the presence of a partition strip, being such that forward movement of a partition strip through said guide means into contact with said edge moves said edge away from said guide means causing pivotal movement of said arm against said bias, and such that a back-up movement of said partition strip while engaged with said edge produces a moment about said pivotal axis tending to pivot said arm in the opposite direction and move said edge toward said guide surface.

13. The assembly of claim 12 wherein said blade extends from said arm at an angle of between about zero to 45° as measured from an axis normal to the plane of the strip and to the forward direction.

14. The assembly of claim 13 wherein said angle is about 20°.

15. A back-up brake assembly for a partition feeder mechanism for preventing back-up movement of a partition strip fed therepast, said assembly comprising a partition guide having a guide surface for movement of a partition strip therealong from a receiving end to a forwad end, a pivot arm, means for mounting the arm for pivotal movement about a generally vertical axis, said arm having an end adapted for engagement with a partition strip as it moves therepast, means resiliently biasing said engaging end toward said guide means for engagement with a partition strip as it moves past, the angle formed between a line extending from said pivotal axis through said engaging end and a line extending from said pivotal axis normal to the plane of said partition strip, with the arm in its fully biased position and without the presence of a partition strip, being approximately 0°.

16. A back-up brake assembly for a partition feeder mechanism for preventing back-up movement of a partition strip fed therepast, said assembly comprising a partition guide having a guide surface for movement of a partition strip therealong from a receiving end to a forward end, a pivot arm, means for mounting the arm for pivotal movement about a generally vertical axis, a finger member extending from said arm toward said guide surface and having an edge for engagement of said strip, said finger member extending from said arm at least as far as said guide surface with the arm in its fully biased position and without the presence of a partition strip, means resiliently biasing the edge of said finger member toward said guide surface for engagement with a partition strip as it moves past, the angle formed between a line extending from said pivotal axis through the edge of said finger member and a line extending from said pivotal axis normal to the plane of said partition strip, with the arm in its fully biased position and without the presence of a partition strip, being such that forward movement of the partition strip through said guide means into contact with said edge moves said edge away from said guide means causing pivotal movement of said arm against the bias, and such that a back-up movement of said partition strip while engaged with said edge produces a moment about said pivotal axis tending to pivot said arm in the opposite direction and move said edge toward said guide surface.

17. The assembly of claim 16 wherein the extension of said finger member is adjustable.

18. The assembly of claim 16 wherein the arm includes a portion extending rearwardly from said pivotal axis, and wherein said resiliently biasing means further comprises a spring means mounted to the rear of said pivotal axis and biasing the rearwardly extending portion away from said partition strip.

* * * * *